United States Patent [19]

Riboud et al.

[11] Patent Number: 5,040,591

[45] Date of Patent: Aug. 20, 1991

[54] LATERAL CLOSING WALL FOR AN INSTALLATION FOR CONTINUOUSLY CASTING BETWEEN MOVING WALLS

[75] Inventors: Paul V. Riboud, Metz; Jean-Pierre Birat, Semecourt; Hervé Tavernier, Vandoeuvre; Jean-Louis Leclaire, Peltre; Michel Larrece, Metz; Jacques Spiquel, Montigy les Metz, all of France

[73] Assignee: Institut de Recherches de la Siderurgie Francaise (IRSID), Puteaux, France

[21] Appl. No.: 536,401

[22] Filed: Jun. 12, 1990

[30] Foreign Application Priority Data

Jun. 15, 1989 [FR] France ..... 89 08086

[51] Int. Cl.[5] ..... B22D 11/06

[52] U.S. Cl. ..... 164/428; 164/480

[58] Field of Search ..... 164/428, 480

[56] References Cited

U.S. PATENT DOCUMENTS 4,754,802 7/1988 Yamauchi et al. ..... 164/428

FOREIGN PATENT DOCUMENTS 59-185548 10/1984 Japan .
59-191549 10/1984 Japan .
60-83754 5/1985 Japan .
60-221155 11/1985 Japan ..... 164/428
63-303658 12/1988 Japan .
1-53737 3/1989 Japan .

*Primary Examiner*—Kuang Y. Lin
*Attorney, Agent, or Firm*—Cushman, Darby & Cushman

[57] ABSTRACT

A closing wall for the lateral end of a casting space of an installation for continuously casting between moving walls which comprises two confronting cooled moving walls (1,2). The closing wall comprises a front part (65) defining a front surface (63) facing toward the casting space and at least one lateral part (66) defining a lateral surface (64) in the extension of the surface of one of the two moving walls and connected to said front surface. The invention is also applicable to the continuous casting of thin metal products between rolls.

13 Claims, 4 Drawing Sheets

Fig. 2
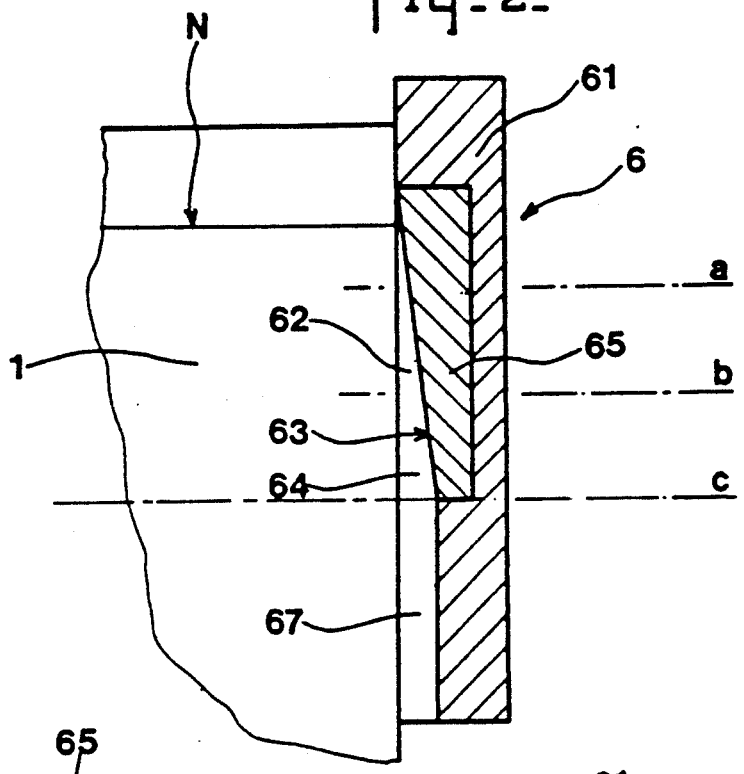
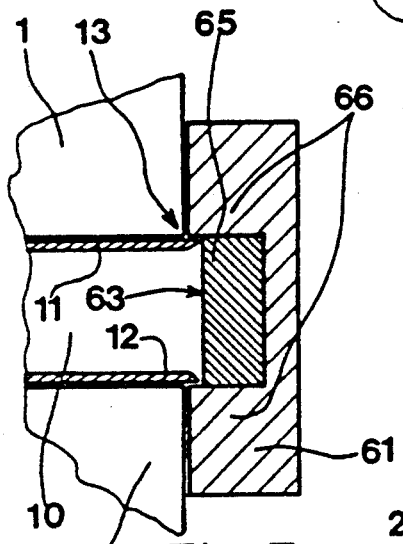
Fig. 3a
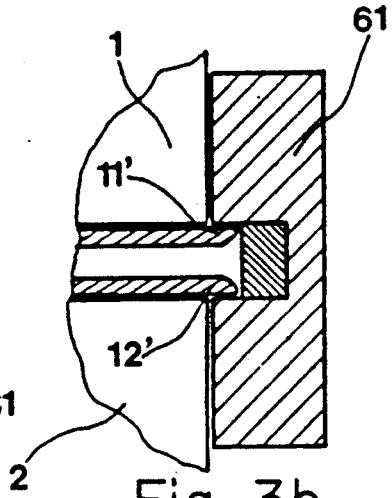
Fig. 3b
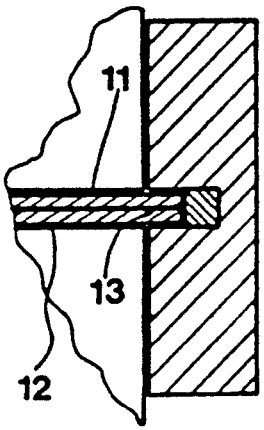
Fig. 3c
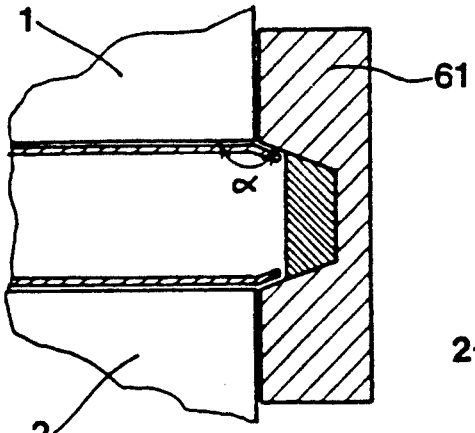
Fig. 9a
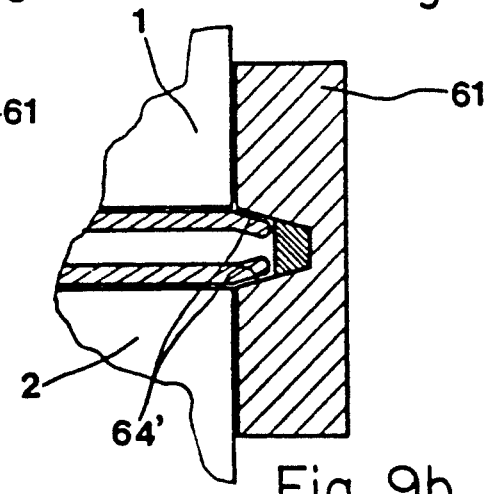
Fig. 9b Fig-4-
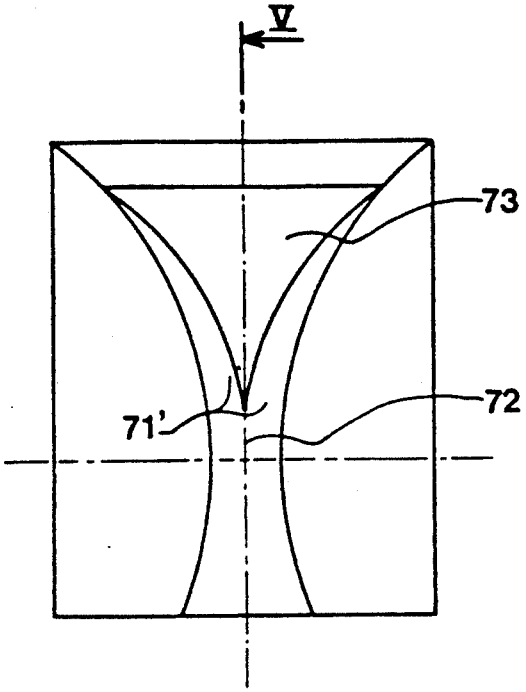
Fig-5-
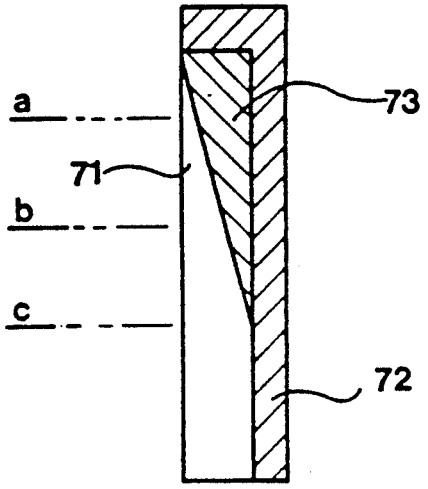
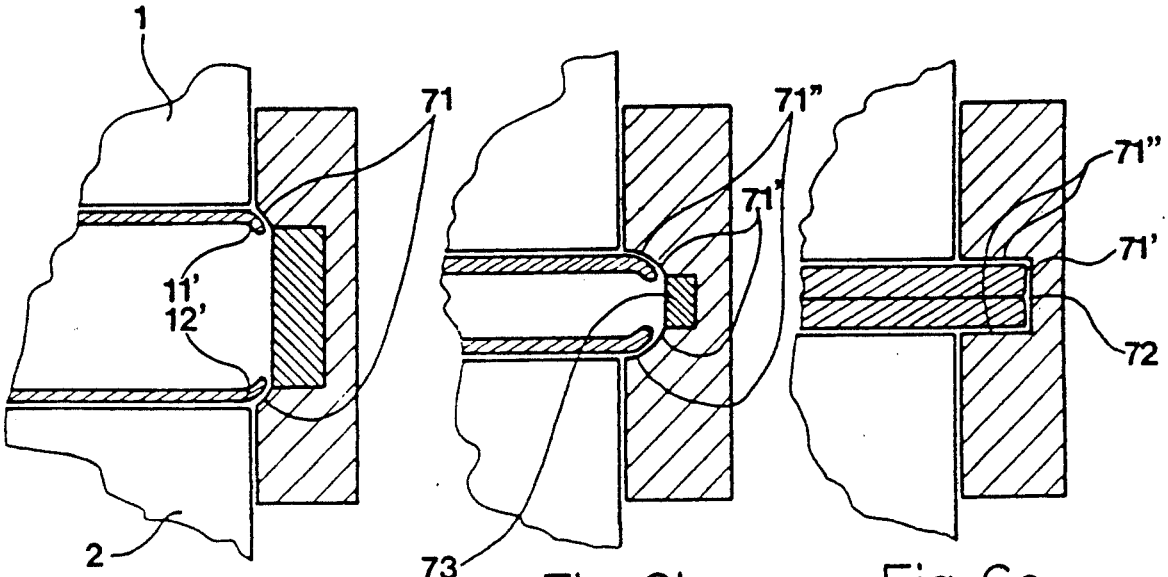
Fig. 6a Fig. 6b Fig. 6c

LATERAL CLOSING WALL FOR AN INSTALLATION FOR CONTINUOUSLY CASTING BETWEEN MOVING WALLS

The invention relates to the continuous casting of thin metallic products between moving walls. More precisely, it concerns means for laterally closing the casting space delimited by said moving walls and located above the neck or isthmus defined as being the region where the moving walls are the closest together.

In order to achieve this lateral closing, it is known, in particular in the case of casting between rolls, to employ fixed walls, still termed "small sides", having a vertical surface placed against the ends of the rolls. Two problems well known in installations of this type are to avoid or limit the solidification of the metal on these walls and to ensure fluidtightness between the walls and the rolls. To avoid this solidification, it has already been proposed to make these walls from a heat insulating material so as to prevent the cooling of the liquid metal on contact with the walls. However, it was difficult to conciliate good insulation characteristics and sufficient strength. Furthermore, the problem of the fluidtightness was latent.

In an attempt to solve these problems, it has already been proposed by the owner of the present patent application (French patent application No. 88 12074) to provide a wall which is inserted between the rolls and is composed of a heat insulating material placed between two curved metal strips marrying up with the curvature of the rolls. With this arrangement, the solidification on the fixed wall may be limited owing to the fact that the material constituting the major part of the fixed wall is not heat conductive. On the other hand, the fluidtightness between the fixed metal strips and the moving rolls is delicate to achieve owing to the fact that the surface of the "joint" between these parts is curved. Furthermore, this arrangement precludes any moving apart of the cylinders owing to risk of infiltration of the liquid metal between the roll and the metal strip, which infiltration could moreover prevent the return of the rolls to their normal distance apart.

An object of the present invention is to provide another solution to the problems of a spurious solidification on the small sides while simplifying the realization of the "joint" between the parts undergoing relative motion, and improving the fluidtightness of this "joint".

With these objects in view, the invention provides a wall for closing the lateral end of the casting space of an installation for continuously casting between two moving walls and comprising two confronting cooled moving walls, this closing wall including a front surface part which faces toward the casting space.

According to the invention, this wall is characterized in that it comprises at least one lateral part maintained against the edge of the moving wall and having a lateral surface facing toward the casting space, said lateral surface being in the extension of the surface of a moving wall and being connected to said front surface recessed in the closing wall.

As will be understood, the basic idea of the invention is to realize the fluidtightness between the moving walls and the fixed end walls in a plane perpendicular to the moving walls, as in the case of a planar closing wall applied against the edges of the moving walls, which considerably simplifies the construction of said fixed walls and allows a possible relative moving apart of the moving walls without adversely affecting the fluidtightness. On the other hand, as the fixed wall, which therefore includes a "recessed" zone (the front part), has a lateral surface in the extension of the surface of the moving wall, the skin of metal which is solidified on contact with the cooled moving wall, is extended substantially without discontinuity by a tongue portion which is solidified on contact with the lateral surface of said lateral part. The solidified skin therefore covers the joint between the moving wall and the fixed wall and thus prevents infiltrations of the liquid metal contained in the casting space.

As the width of said lateral surface of the fixed wall is small, the tongue portion forming the edge of the solidified skin is of small size. As moreover this tongue portion is solidified simultaneously with the part of the skin formed on contact with the cooled moving wall, it is driven along with this part of the skin and slides on said fixed lateral surface with practically no risk of catching. In order to still further reduce this risk, it is moreover possible to lubricate the lateral surface in a manner similar to the lubrication of a conventional continuous casting ingot mould.

Further features and advantages of the invention will be apparent from the following description of a closing wall according to the invention and an installation for continuously casting between rolls including said closing wall. Reference will now be made to the accompanying drawings, in which:

FIG. 2 is a sectional view taken in plane II—II of FIG. 1;

Figure 8:
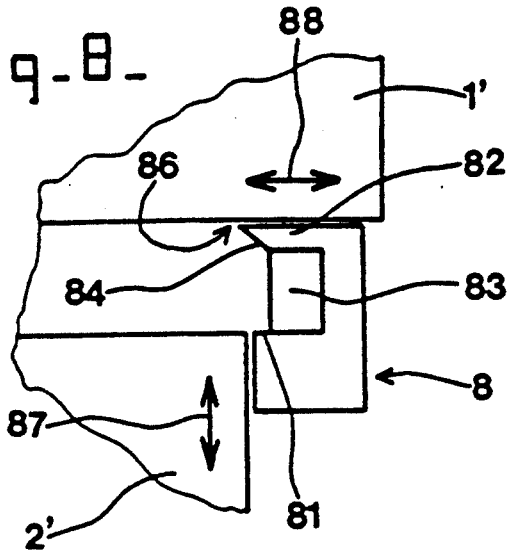
Figure 7:
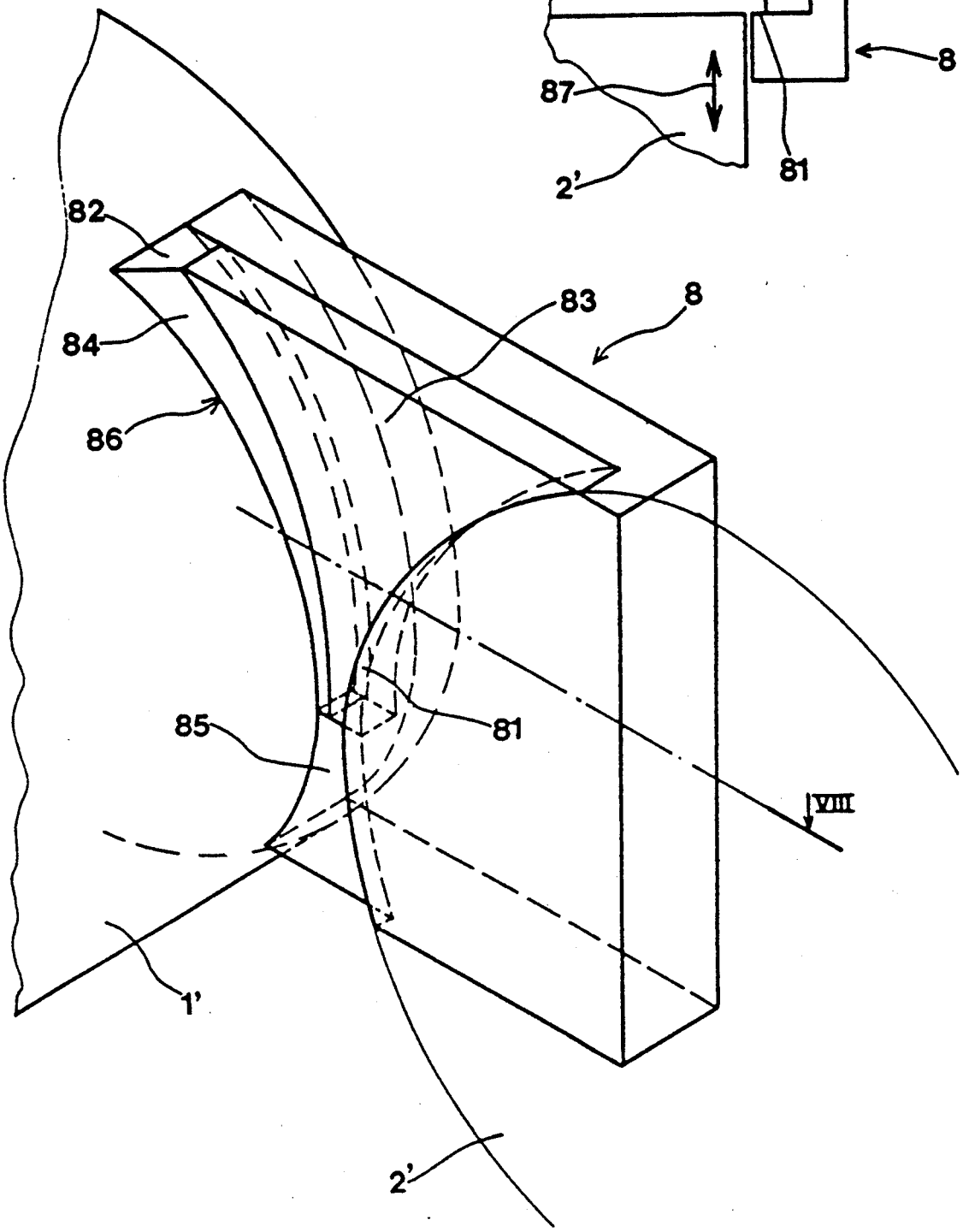

FIGS. 3*a*, 3*b*, 3*c* are diagrams-showing the evolution of the solidification of the cast product at the different levels a, b, and c shown in FIG. 2;

FIG. 4 is a diagrammatic front elevational view of a variant of the fixed wall;

FIG. 5 is a sectional view taken on line V—V of FIG. 4;

FIGS. 6*a*, 6*b*, and 6*c* are diagrams similar to those of FIG. 3 in the case of the variant shown in FIGS. 4 and 5;

FIG. 7 is a view of another variant adapted to the case of an installation comprising rolls which are axially movable relative to each other for the purpose of modifying the width of the cast product;

FIG. 8 is a horizontal sectional view in the region VIII of FIG. 7, and

FIGS. 9*a* and 9*b* are diagrams similar to those of FIGS. 3*a* and 3*b* in the case of a variant in which the lateral surfaces are inclined relative to the surfaces of the cylinders. It must be mentioned that the various drawings are given merely for explanatory purposes and it will be understood that the relative dimensions of the various elements have not been respected in order to facilitate the understanding of the subject matter and the objects of the invention.

Figure 1:
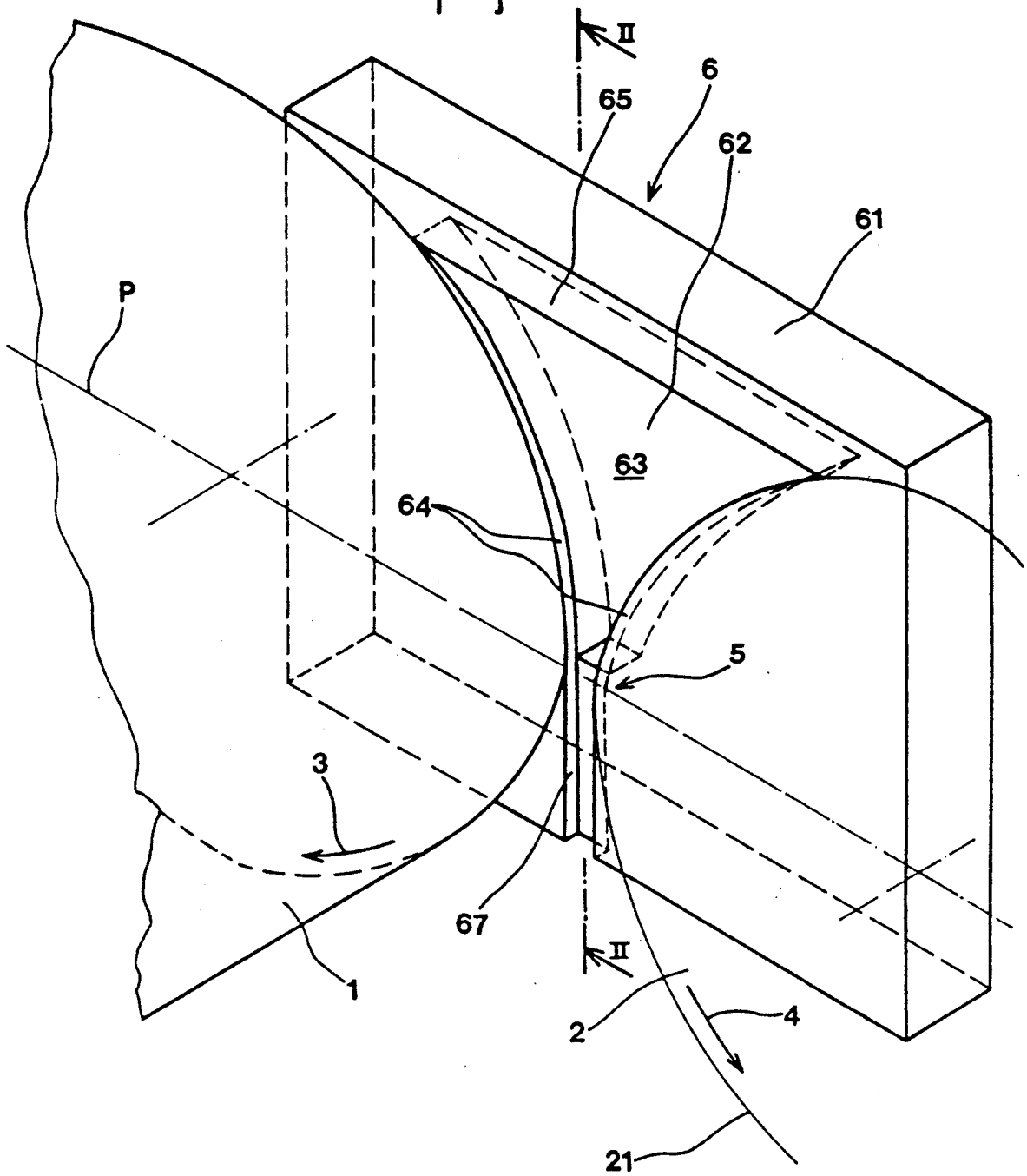
FIG. 1 is a partial diagrammatic view of an installation for continuously casting between rolls, showing the arrangement of a closing wall according to the invention.

Shown in FIG. 1 is one end of an installation for continuously casting between two rolls, this installation comprising two rolls 1 and 2 the second roll of which has only been symbolically represented by the trace 21 of the end of its wall.

The two rolls which have parallel axes and are contained in a common horizontal plane P, are driven in rotation in opposite directions shown by arrows 3 and 4, and spaced apart at the level of the neck 5 corresponding to the level of the plane P passing through the axes of the rolls, a distance corresponding to the desired thickness of the cast product.

The liquid metal is fed, according to one of the well-known methods, to the casting space delimited, on one hand, by the part of the walls of the rolls located above the neck and, on the other hand, by the closing walls located at the edges of the rolls and in fluidtight contact with these edges. It will be understood that, as the closing walls are fixed and the roll walls are moving, a minimum functional clearance must be provided therebetween in order to avoid an intense friction and wear which would otherwise result. Consequently, the fluidtightness cannot be absolute and there is a risk of infiltrations of liquid metal. A reduction in this risk of infiltrations is in particular one of the objects of the present invention.

Indeed, if the closing wall is uniformly planar and made, as mentioned at the beginning of this specification, from a material which is sufficiently insulating so that the liquid metal does not solidify on contact therewith, the solidified metal skin in contact with the cooled walls of the rolls stops just in the region of the joint between the closing wall and the roll, and there is consequently great risk of infiltration in this region.

The idea behind the present invention is in fact to achieve fluidtightness with respect to the liquid metal by encouraging the extension of the solidified skin on the part of the closing wall which is immediately adjacent to the rolls. Consequently, it is the solidified skin which covers the joint between the roll and the closing wall and constitutes a fluidtight wall precluding infiltrations.

FIG. 1 represents a closing wall, or "small side" 6, constituted by a vertical plate 61 maintained against the ends of the rolls 1 and 2 with a functional clearance.

This plate 61 is recessed in the part thereof in direct contact with the casting space so as to define a recess 62 delimited by a front surface 63 and two lateral surfaces 64 in the extension of the cylindrical surfaces of the rolls 1 and 2. These surfaces are therefore portions of a cylindrical surface having the same curvature as the rolls and extending downwardly to the level of the neck 5.

The front surface 63 is planar and slightly inclined to the vertical so that this surface is downwardly slightly inclined away from the casting space. As is known, this inclination allows in the course of casting the lateral expansion of the product undergoing solidification which might result from the rolling effect of the rotating rolls. Consequently, the width of the lateral surfaces 64 increases in the downward direction to the level of the neck.

As variants (not shown), the front surface 63 may also be vertical (the width of the lateral surfaces 64 then being constant) or slightly curved.

In the illustrated embodiment, the front surface 63 is the surface of a front member 65 mounted in a recess machined in the plate 61, this front member being made of a heat insulating refractory material. The lateral surfaces 64 are formed by the surfaces of the lateral parts 66 made of a metallic material and preferably cooled, for example by an internal circulation of a cooling fluid. The recess 62 continues below the neck in the form of a groove 67 of constant width forming a guide for the edges of the cast product in which the solidification of these edges can terminate.

The diagrams of FIG. 3 show the evolution of the formation of the solidified skins in the course of casting. In the course of the casting, the casting space is fed with liquid metal. The latter is solidified on contact with the cooled walls of the rolls and also on contact with the lateral surfaces 64 of the closing wall 6.

At the level a of FIG. 2 (FIG. 3*a*), located slightly below the level of the meniscus N, the liquid metal 10 has started to solidify by forming skins 11 and 12 which extend into the recess 62 to the front surface 63 while overlapping the joint zone 13 between the edge of the rolls 1 and 2 and the lateral parts 66 of the closing wall 6.

At the intermediate level b of FIG. 2 shown in FIG. 3*b*, the metal has continued to solidify. As they approach each other, the skins 11 and 12 thicken and the edges 11' and 12' are prolonged as the metal travels along the inclined front surface 63.

At the level c corresponding to the level of the neck 5, the two skins 11 and 12 join up and form the completely solidified finished product 13.

Note that the skins 11 and 12 solidified on contact with the walls of the rolls accompany these walls in their movement substantially without relative slip. On the other hand, the edges 11' and 12' of these skins solidify on contact with the fixed lateral parts 66 of the closing walls and slide along the latter. In order to facilitate this sliding, the surfaces of these lateral parts may be advantageously lubricated; for example means may be provided for injecting a lubricating fluid in the region of the joint plane between the rolls and the closing walls, which may present the additional advantage of reducing friction and therefore wear between these elements.

In a variant, the lateral surfaces 64 need not be precisely in alignment with the cylindrical surfaces of the rolls but may make therewith an angle different from 180°, such as the obtuse angle $\alpha$ shown in the diagrams of FIG. 9. In other words, the trace of this lateral surface in a horizontal plane makes an obtuse angle with the generatrix of the adjacent moving wall contained in the same plane.

This angle may be constant throughout the height of the recess and, in this case, the cast product will have a thinner edge than the central part of the product. The lateral surfaces are then frustoconical. This angle may also progressively open toward the base of the recess, as shown in FIG. 9*b*, and reach the level of the neck at a flat angle, the section then being identical to that shown in FIG. 3*c*. In this case, the lateral surfaces 64' are then warped surfaces.

FIGS. 4, 5 and 6 relate to another variant of the invention in which the lateral surfaces 71, while remaining in the extension of the cylindrical surfaces of the rolls, have such configuration that they progressively encroach on the front part until they join up in proximity to the level of the neck between the rolls and form said front surface 72 at this level. In this variant, the front part 73 composed of a refractory material having good heat insulating characteristics, terminates in a downwardly directed point between the front surface zones 71' resulting from the progressive deformation of the lateral surfaces 71. As can be seen in the diagrams of FIG. 6, the lateral surfaces 71 become progressively deeper from the top to the bottom of the closing wall in a rounded portion (FIGS. 6*a* and 6*b*) in forming a part 71' which remains in the extension of the surfaces of the rolls, and the part 71' which tangentially joins up with the surface of the front part 73. This rounded portion undergoes an evolution until it forms, in the region of the neck, a right angle (FIG. 6c). There is in this case a continuity, throughout the height of the closing wall, of the metallic material in contact with which the edges of the skins solidify, these edges of the solidified skins 11' and 12' therefore avoiding contact with the insulating material 73—even in the vicinity of the neck.

A further variant, applied to the case where the rolls are axially offset from each other, is represented in FIGS. 7 and 8. In this variant, the closing wall 8 is so shaped as to be applied, on one hand, against the end surface of a roll 2' and, on the other hand, against the cylindrical surface of the other roll 1'. One half of the wall 8, namely that adjacent to the roll 2', is similar to one of the previously-described configurations and defines a lateral surface 81 in the extension of the cylindrical surface of the roll 2'. The other half, adjacent to the roll 1', is similar to the device described in the aforementioned French patent application No. 88 12074 the teaching of which is incorporated herein by reference. This second half is so shaped as to define a curved surface which has the same radius as the roll 1' and is placed against the cylindrical surface of the latter. A metal strip 82 lies alongside the central wall zone 83 composed of refractory material. The surface 84 of this strip, facing toward the casting space is a warped surface forming a bevel at its upper end.

The acute angle of this bevel increases in an even manner in the downward direction and reaches a right angle in the region of the neck between the rolls where the surface 84 joins a shoe 85 perpendicular to the axes of the rolls. More details concerning the shape and the purpose of this strip may be had from the aforementioned patent application. It is here merely mentioned that this strip enables the skin solidified on the roll 1' to extend along the surface 84 of the strip while covering the joint zone 86 between the roll and said strip so that fluidtightness of the casting space is achieved in this zone. With this arrangement, the fluidtightness of the casting space is ensured just as well between the closing wall and the roll 2' as between this wall and the roll 1'. This variant is particularly adapted to an installation for casting between axially movable rolls intended in particular to cast products of variable width. It will be noted that not only may the wall 8 be shifted relative to the roll 1' in the axial direction 88 without destroying the fluidtightness between these elements, but the two rolls may be shifted slightly toward each other or away from each other (in the direction of arrow 87) owing to the fact that the roll 2' may be shifted in a direction perpendicular to the axial direction with respect to the closing wall 8, without varying the functional clearance between the roll 2' and this closing wall.

Various combinations of the previously-described variants may of course be adopted by adapting, according to each case, for example the angle of inclination relative to the vertical of the front surface of the closing wall or the inclination of the surfaces (64, 71, 84) of said wall facing toward the casting space.

Further, the materials making up the various parts of the closing wall may be adapted to the type of metal being cast insofar as the material of the central part of the wall is a refractory material so chosen as to have low heat conductivity. The lateral parts may also be made from a refractory material but will preferably be metallic and cooled, as mentioned hereinbefore.

What is claimed is:

1. Closing wall in combination with an installation for continuously casting between moving walls, said installation comprising two confronting cooled moving walls defining a casting space having lateral ends, said closing wall having for purpose to close a respective one of said lateral ends and comprising a front part defining a front surface facing toward said casting space, at least one lateral part maintained against an edge of one of said moving walls and defining a lateral surface in the extension of a surface of said one of said moving walls and connected to said front surface recessed in the closing wall.

2. Closing wall according to claim 1, wherein said front part and said at least one lateral part are composed of a refractory material.

3. Closing wall according to claim 1, wherein said front part is composed of a heat insulating refractory material and said at least one lateral part is composed of metal.

4. Closing wall according to claim 3, wherein said at least one lateral part is cooled.

5. Closing wall according to claim 1, wherein said front surface is downwardly inclined to the vertical away from said casting space.

6. Closing wall according to claim 1, wherein the trace of said lateral surface in a horizontal plane makes an angle which is different from 180°with the adjacent moving wall generatrix contained in the same plane.

7. Closing wall according to claim 1, wherein said front surface and lateral surface are extended vertically below the level of a neck defined by the moving walls and form a guide groove for the cast product.

8. Closing wall according to claim 1, wherein two of said at least one lateral surface are provided and so shaped as to downwardly progressively encroach on said front part until they join up in proximity to the level of a neck defined by the moving walls and form said front surface at this level.

9. Device for continuously casting between rolls, comprising two confronting cooled rotatable rolls defining a casting space having lateral ends, two closing walls for respectively closing said lateral ends of said casting space, each of said closing walls comprising a front part defining a front surface facing toward said casting space, at least one lateral part maintained against an edge of a respective one of said rolls and defining a lateral surface in the extension of a surface of one of said moving walls and connected to said front surface recessed in the closing wall.

10. Device for continuously casting between rolls, comprising two confronting cooled rotatable rolls defining a casting space having lateral ends, two closing walls for respectively closing said lateral ends of said casting space, each of said closing walls comprising a front part defining a front surface facing toward said casting space, and two lateral parts maintained against respective edges of said rolls and defining lateral surfaces in the extension of respective surfaces of said moving walls and connected to said front surface recessed in the closing wall.

11. Device according to claim 9, wherein the two rolls are axially offset from each other, each closing wall defining on one side thereof a single one of said lateral surfaces in the extension of a cylindrical surface of one of said rolls and being so shaped on another side thereof as to match up with the curvature of a cylindrical surface of the other roll of said rolls.

12. Device according to claim 9, comprising means for injecting a lubricant in the region of a joint plane between said rolls and each closing wall.

13. Device according to claim 11, comprising means for injecting a lubricant in the region of a joint plane between said rolls and each closing wall.

* * * * *